US008454484B2

(12) United States Patent
Keen et al.

(10) Patent No.: US 8,454,484 B2
(45) Date of Patent: Jun. 4, 2013

(54) CLOSED LOOP DEVICE INCORPORATING ONE OR MORE INDECOMPOSABLE KNOTS AND METHODS OF USING

(76) Inventors: Brian T. Keen, Pinch, WV (US); Frank M. S. Ma, Charleston, WV (US)

( * ) Notice: Subject to any disclaimer, the term of this patent is extended or adjusted under 35 U.S.C. 154(b) by 411 days.

(21) Appl. No.: 12/814,054

(22) Filed: Jun. 11, 2010

(65) Prior Publication Data

US 2011/0306477 A1 Dec. 15, 2011

(51) Int. Cl.
*A63B 21/00* (2006.01)
*B60P 3/079* (2006.01)

(52) U.S. Cl.
USPC ..... 482/92; 24/298; 24/68 R; D9/455; 224/218

(58) Field of Classification Search
USPC ..... 482/121–129, 137, 148, 91, 140; 24/298, 24/300–302; 114/102.18; 224/218, 68 R, 224/17 B; 294/150; D9/155, 434
See application file for complete search history.

(56) References Cited

U.S. PATENT DOCUMENTS 4,221,024 A 9/1980 Becker
4,355,801 A 10/1982 Thomsen
4,885,824 A * 12/1989 Schwab et al. ..... 24/17 B
5,518,486 A * 5/1996 Sheeler ..... 482/131
6,036,626 A 3/2000 Taylor
6,447,037 B1 * 9/2002 Crouch ..... 294/149
6,637,077 B2 * 10/2003 Doty ..... 24/302
6,708,650 B1 3/2004 Yates
7,657,952 B2 * 2/2010 Hutchison ..... 5/420
2007/0173382 A1 7/2007 Axelrod
2008/0116239 A1 5/2008 Lu
2008/0283566 A1 11/2008 Chace
2010/0032537 A1 2/2010 Andrews

OTHER PUBLICATIONS http://www.practicestraps.com/, 8 pages, Aug. 5, 2010.
http://shop.lululemon.com/Stretch_Ngo_Strap/pd/c/640/np/640/p/1527.html, 5 pages, Apr. 27, 2010.

* cited by examiner

*Primary Examiner* — Stephen Crow
(74) *Attorney, Agent, or Firm* — Kagan Binder, PLLC

(57) ABSTRACT

A flexible, closed loop device that includes at least one indecomposable knot formed that helps define a plurality of adjustable loops. The knot can be easily loosened so that the loop sizes can be adjusted. The knot is easily tightened and locked. In some embodiments, the device includes at least two indecomposable knots. The device is useful in the practice of yoga, Pilates, and other personal training exercises. The device is flexible and easily adjustable, allowing the user to more effectively target specific muscle groups. The device may additionally or alternately be used as a securing and carrying strap for items. Still further, the device may be used as a connecting device to link items together for towing, hoisting, etc.

22 Claims, 16 Drawing Sheets

CLOSED LOOP DEVICE INCORPORATING ONE OR MORE INDECOMPOSABLE KNOTS AND METHODS OF USING

FIELD OF THE INVENTION

This invention generally relates to a readily adjustable closed loop device such as a closed loop strap or belt incorporating one or more indecomposable knots and methods of using such devices. The devices may be used as an exercise aid, for use during exercising and/or stretching. Additionally or alternately, the devices may be used as a carrying device, including a device for securing the item being carried. Still further, the devices may be used as a connecting device to link items together.

BACKGROUND OF THE INVENTION

Stretching is an important aspect of many exercise programs and contributes to physical and mental health (as in the case of yoga or Pilates). Stretching helps muscles achieve flexibility and builds strength, all while toning the body. Stretching aids such as belts are widely used to enhance the effectiveness of stretching. Many known stretching devices, unfortunately, are complex and cumbersome to manufacture, use and/or adjust. Many of such devices also can be adjusted in size, but the practical uses of the devices are limited. Thus, many of these devices are only useful as a stretching aid and are not readily adapted for other uses. Some rely solely upon hardware components in order to allow adjustment. Some hardware is heavy, making use as a stretching aid more difficult. Some hardware also has sharp edges, pinching features, or the like that pose a risk of injury to the user or a risk of damage to items that are stored with or carried with such devices.

It is therefore highly desirable to have an exercise aid that could help to improve the performance of the users in an easy and effective manner. It would also be desirable if the device practically and easily has utilities in addition to being used as an exercise aid.

SUMMARY OF THE INVENTION

The present disclosure provides a flexible closed loop device useful in a wide range of activities. The devices of the invention are simple to manufacture and use, are easy to adjust, and are adaptable to the needs of the user while being effective, safe, and comfortable to use at the same time. The devices desirably can be adjusted in both size and configuration so that the devices can have multiple uses.

The device of this invention is a closed loop that includes at least one indecomposable knot. Such a knot can be easily loosened and can have its position adjusted. The knot is then easily tightened and locked. A preferred knot is a trefoil knot. The device may be used as a single loop or as multiple loops (e.g., two loops, three loops, etc.). Loops can be used separately or overlapped so as to create, in practical effect, a multi-stranded loop. If multiple loops are present, they may have the same or differing sizes.

Because the devices are flexible and easily adjustable, using the devices as an exercise aid allows the user to more effectively target specific muscle groups, such as commonly required in yoga and Pilates training, in martial arts, running, or other athletic warm up stretching exercises. The device can be used for isometric, isotonic, stretching, and aerobic exercises. For exercising, the device is preferably a closed loop strap device.

The flexible device is also useful for securing and/or carrying items. As an example, a user can use a strap device for stretching or other exercises that utilize an exercise mat. Additionally, the user can use the same strap device for securing and carrying the exercise mat to and from the exercise location. As other examples, smaller items, such as a water bottle, can be carried with a single loop secured around the bottle while another loop is used as a grip to hold the bottle or attachment to secure the bottle to a clip, hook, or the like. Larger items, such as skis and/or ski poles, can be carried with two loops around the skis and/or poles while another loop is used to help carry the items. The device may have one or more knots that form the various loops to assist with the desired functionality.

The flexible strap device is also useful for connecting or helping to secure items. Because of the ease of adjusting and then securing the length of the device, the device can be used to connect two items together with a prescribed distance there between. For example, a strap device can be used for towing or hoisting items, for holding a door open, or for staking a tree. The adjustability of the knots allows the device to be securely attached to items being hoisted, towed, secured, etc.

In one aspect, the present invention relates to an exercise device, comprising a flexible, closed loop body; and at least one indecomposable knot formed in the loop body, the knot defining a plurality of adjustable loop portions.

In another aspect, the present invention relates to a closed loop strap device with adjustable loop portions, comprising a flexible strap body forming a continuous loop; a first indecomposable knot formed in the strap body; and a second indecomposable knot formed in the strap body, the first and second knots defining a plurality of adjustable loop portions.

In another aspect, the present invention relates to a method of exercise comprising the steps of providing a closed loop device comprising a flexible body forming a continuous loop with at least one indecomposable knot formed in the body, the knot defining a plurality of adjustable loop portions; and using the device as an exercise aid.

In another aspect, the present invention relates to a method of using a closed loop device, comprising the steps of providing a closed loop device comprising a flexible body forming a continuous loop with at least one indecomposable knot formed in the body; performing an exercise on a mat using the closed loop device as an aid; and carrying the mat using the closed loop device.

In another aspect, the present invention relates to a method of carrying at least one item, comprising providing a closed loop device comprising at least one indecomposable knot formed in a body, the knot defining at least first and second adjustable loop portions; placing the at least one item in the first loop portion; cinching the knot to secure the at least one item in the first loop portion; and using the second loop portion as a handle to carry the at least one item.

In another aspect, the present invention relates to a closed loop device with adjustable loop portions, comprising a flexible body forming a continuous loop, and at least two indecomposable knots formed in the loop body, the knots defining a plurality of adjustable loop portions.

BRIEF DESCRIPTION OF THE DRAWINGS

The invention may be more completely understood in consideration of the following detailed description of various embodiments of the invention in connection with the accompanying drawing, in which.

DETAILED DESCRIPTION OF PRESENTLY PREFERRED EMBODIMENTS

Figure 1:
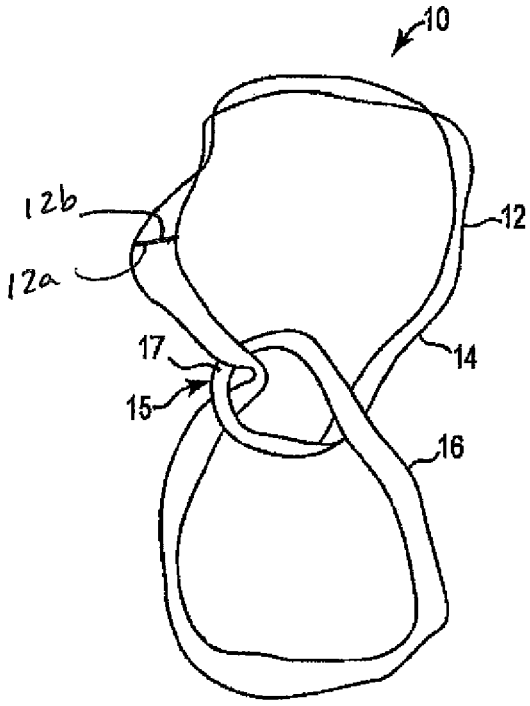
FIG. 1 is a plan view of a closed loop device having a single indecomposable knot, in particular, a trefoil knot.

Referring now to the Figures, FIG. 1 illustrates a first embodiment of a flexible device 10 according to this disclosure. Closed loop device 10 of FIG. 1 has a strap body 12, with body 12 being continuous without a free end. Body 12 may be formed from a body whose ends 12*a*, 12*b* are permanently attached to form a closed loop structure such as by being integrally formed, riveted, stitched, or otherwise secured together in a manner such that closed loop body 12 cannot be reversibly opened and closed unless body 12 were to be severed to create free ends 12*a*, 12*b*. In other embodiments, body 12 may be formed from a length of material whose ends 12*a*, 12*b* can be reversibly closed and opened such as by a buckle, clasp, button, snap, pin, or the like. For purposes of illustration, body 12 is shown as a closed loop that must be severed to be opened.

Body 12 has an indecomposable knot 15 formed therein. In accordance with knot theory, an indecomposable knot refers to a knot that cannot be written as the sum of two non-trivial knots. Indecomposable knots are referred to in knot theory as prime knots. In the practice of the present invention, the term indecomposable refers to any knot that when formed in a closed loop has the characteristic that the knot cannot be fully untied unless the closed loop is opened or severed. For purposes of the present invention, indecomposable knots include but are not limited to prime knots formed in a closed loop. Examples of prime knots are torus knots, which are formed by wrapping a circle around a torus p times in one direction and q times in the other direction, where p and q are co-prime integers.

Figure 11:
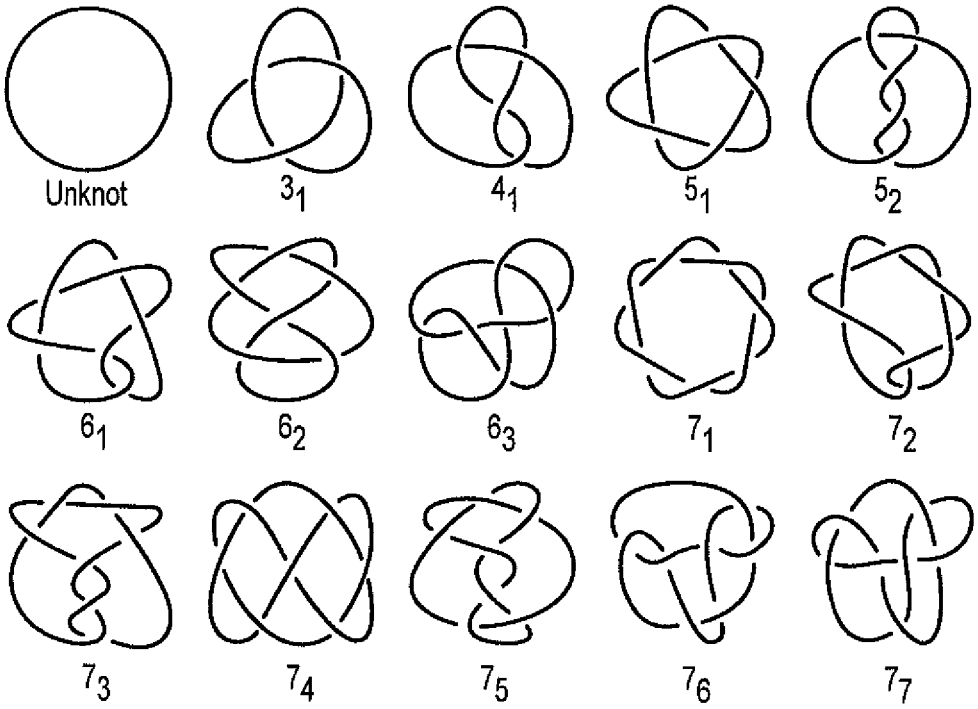
FIG. 11 is a chart of prime knots suitable for the flexible device.

Preferred knot embodiments used in the practice of the present invention are prime knots with seven or fewer crossings, more preferably five or fewer crossings, and even more preferably three crossings. For reference, FIG. 11 is a chart of all prime knots with seven or fewer crossings, not including mirror images. The simplest prime knot is the trefoil knot (identified as $\mathbf{3}_1$ in FIG. 11), which has three crossings. The trefoil knot is a 3,2-torus knot. The trefoil knot may be left-handed or right-handed, and both orientations are suitable for this invention.

Returning to FIG. 1, knot 15 can be formed in a variety of ways. According to one manufacturing technique, an open length of suitable material to form body 12 is provided. While the ends of the material are free, the length of material is manipulated to form knot 15 from the material itself. Most desirably and as shown in FIG. 1, knot 15 is formed solely by this material. That is, in preferred embodiments, there is no hardware or additional component or element that forms knot 15 or the corresponding loop portions. Thus, the resultant device 10 has no clasps, buckles or other hardware that could create a pressure point, pinch point or sharp edge.

After knot 15 is formed, the ends of the material are joined together to form the closed loop. The ends can be joined in any desired fashion. Once the material is closed to form closed loop body 12, the indecomposable, knot 15 cannot be removed from the closed loop body 12 unless free ends of body 12 were to be re-established such as by severing or otherwise opening body 12 to free the ends.

Knot 15 subdivides the closed loop body 12 into a plurality of adjustable loop portions 14, 16, and 17. When knot 15 is uncinched or loosened as shown, the size of the loop portions 14, 16, and 17 are easily adjusted to form a desired configuration. As illustrated, loop portions 14 and 16 are relatively large, while loop portion 17 is moderately small but still open so that knot 15 is uncinched. Knot 15 can be cinched to secure the loop portions 14 and 16 by pulling on these loop portions to close loop portion 17. When these loop portions 14 and 16 are tensioned, knot 15 remains cinched and the configuration of device 10 is generally secured. When the tension is released, knot 15 may be uncinched and the loop portions are easily adjusted. As shown in FIG. 1, loop portions 14 and 16 are comparably sized, but these can be adjusted so that one of these is larger than the other.

The loop portions 14, 16, and 17 defined at least in part by knot 15 are dependently adjustable in relation to each other. That is, increasing the size of one loop portion (e.g., loop portion 14) generally adjusts, e.g., decreases the size of, at least one other loop portion (e.g., loop portion 16 and/or 17).

Each of the loop portions can perform various functions such as acting as an engagement strap for the limbs to enhance stretching during exercise (e.g., a foothold or handhold). Any loop portion(s) may function as hand grip(s) to allow effective pulling by the user using one hand (instead of two, although two can be used as desired) without slipping off in contrast to using conventional exercise belts. Loop portions also can serve as securement straps and/or handholds for carrying one or more items, such as a yoga mat with at least one remaining loop desirably being used as a sling or a handle. Loop portions may be used to connect two or more items. By folding one or more loops over on themselves, a multistranded loop can be formed. Also, the desired length of the device can conveniently be adjusted in this manner.

Advantageously, therefore, the indecomposable knot 15 functions both as an adjustable cinch and a locking device to control the size of the loop portions to customize strap device 10 for the desired use. When knot 15 is uncinched, the size of the loop portions is easily increased or decreased as desired, and the loop configuration can be locked by cinching knot 15. Knot 15 stays securely locked when knot 15 is under tension. For instance, the size and number of the accessible loop portions can be adjusted to fit one or more body parts before or during exercise or can be adjusted to secure item(s) being carried or connected. The easily adjustable indecomposable knot(s) allow easy loop adjustments in the midst of exercise.

Not only is strap device 10 easy to adjust and lock, because of its simple design and the avoidance of hardware, strap device 10 is easy to carry and store, being readily collapsible with minimal tangling. It can fold or compact easily to fit comfortably in a pocket. This is very convenient when device 10 is used as a ski tote or mat carrying strap, as strap device 10 can be stored in the pocket of a user's ski coat until the end of skiing or in an exercise bag pocket until the end of exercising. Additionally, because of the simple design and the avoidance of hardware, the strap device is very economical to manufacture. In use, strap device 10 is easily adjustable without the need of tools or uncommon finger dexterity.

FIGS. 2A through 2F illustrate various configurations for an embodiment of the present invention in the form of a closed loop strap device 20 comprising a closed loop, generally flat strap body 22 having opposed major faces. Strap device 20 includes a single knot 25 formed in strap body 22. Knot 25 defines a plurality of adjustable loop portions 24, 26, and 28.

Figure 2A:
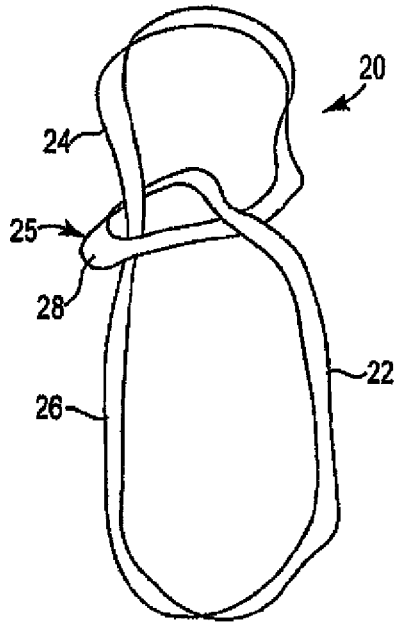
FIG. 2A is a plan view of the device of FIG. 1 with the knot forming two adjustable loops.

In FIG. 2A, the single knot 25 is uncinched (e.g., loosened) and body 22 is adjusted to form relatively larger loop portions 24 and 26 in, while the sizes of loop portion 28 is minimized. When no tension is on device 20, body 22 can be readily adjusted to change the sizes of loop portions 24, 26, and 28. Decreasing (increasing) the size on one loop portion, e.g., loop portion 24, will increase (decrease) the size of another loop portion, e.g., loop 26 and/or loop 28. In this sense, the loop portions are dependently adjustable. By adjusting the sizes of the loop portions, a pair of suitable loop portions can be obtained functioning as a strap or hold for the foot and hand. The third loop portion may serve as a pulling cord to adjust the sizes of the various loop portions before and/or during an exercise. Knot 25 can be cinched tight to secure the desired configuration of device 20.

Figure 2B:
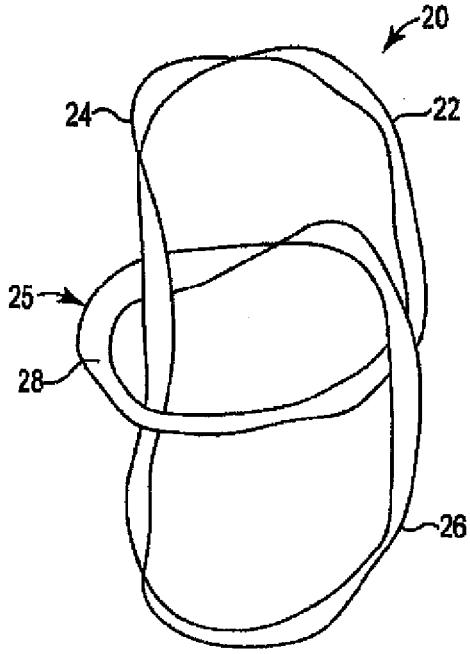
FIG. 2B is a plan view of the device with the knot loosened to form three adjustable loops.

By further expanding the indecomposable knot 25, three loop portions 24, 26, 28 of approximately equal sizes can be formed, as illustrated in FIG. 2B. In use, for example, loop portion 28 can function as a hold (e.g., handhold or foothold) while the two other loop portions 24, 26 function as the pulling straps or visa versa. Again, knot 25 can be cinched tight to secure this configuration of device 20.

Figure 2D:
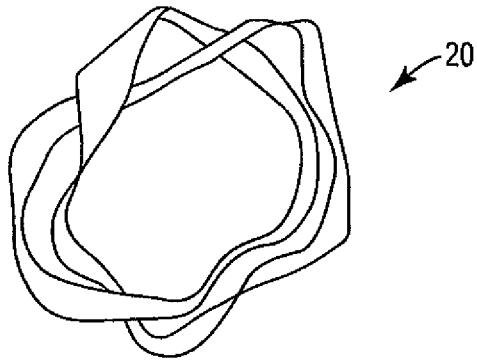
FIG. 2D is a plan view of the device doubled to form a single loop.
Figure 2C:
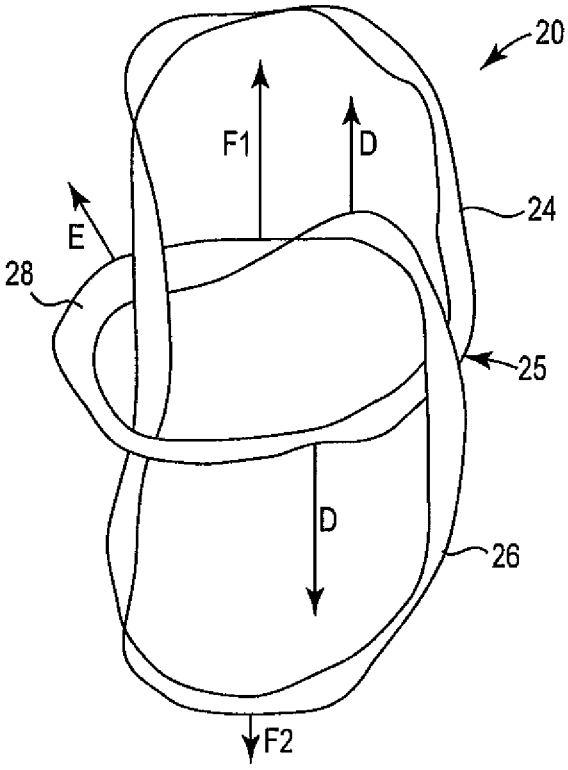
FIG. 2C is a plan view of the device with directional arrows indicating movement.
Figure 2E:
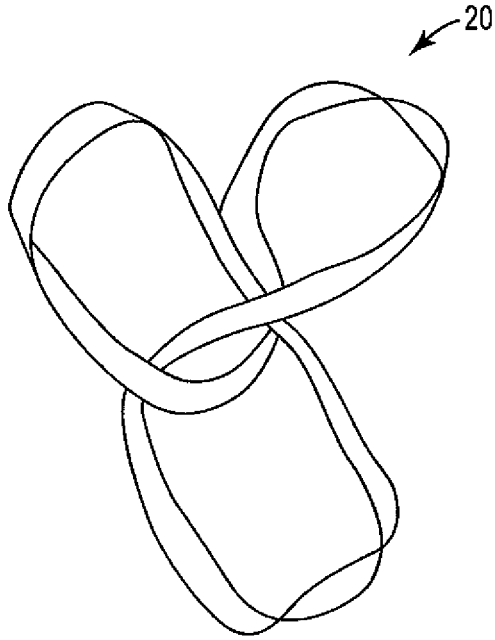
FIG. 2E is a plan view of the device forming a triangular form with three essentially equal loops.
Figure 2F:
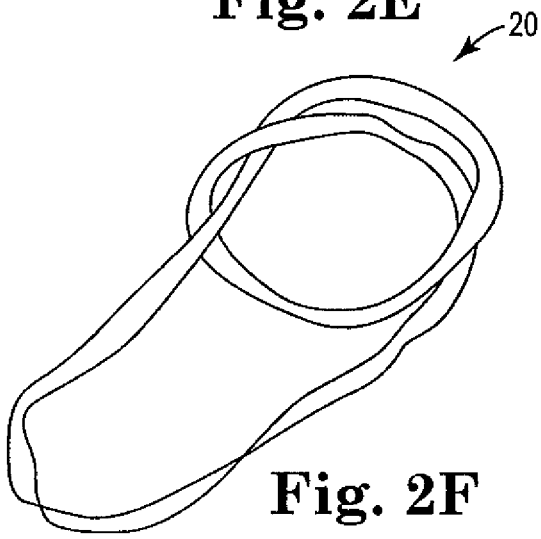
FIG. 2F is a plan view of the device doubled to form a smaller loop within a larger loop.

Closed loop device 20 can be adjusted in various ways, as schematically illustrated in FIG. 2C, to obtain the configurations shown in FIGS. 2D, 2E and 2F. Thus, adjustment of knot 25 and loop portions 24, 26, 28 will provide numerous configurations as desired by the user. FIG. 2D illustrates how two main loop portions can be formed and overlapped to form a double-stranded, loop configuration by expanding loop portions 28 as indicated by arrows D in FIG. 2C. The resulting device can be used as a hold (e.g., handhold, foothold, etc.) and also as a pulling strap. The adjustability of loop portions is indicative of the ease of changing the length of the pulling strap to adapt to the flexibility of the users during stretching or other exercise.

By expanding loop portion 28 diagonally as indicated by arrow E in FIG. 2C, the resulting configuration of FIG. 2E has three triangularly oriented, adjustable loop portions. Each of the three loop portions can function as an engagement strap for exercise so that device 20 can simultaneously engage multiple limbs (e.g., two feet and one hand, or two hands and a foot, etc.) for stretching, as would be known to a person skilled or knowledgeable in stretching exercises. Further, folding or otherwise overlapping all three loops of FIG. 2E on themselves results in a triple-stranded, high-strength loop somewhat smaller than the double loop of FIG. 2D. Such a reduction in the strap length decreases the distance between the two limbs to intensify the stretch for better results.

FIG. 2F illustrates an overlapped double loop configuration for device 20. By pulling loop, 28 as indicated by arrow F1 in FIG. 2C, towards the end of loop portion 24 and by pulling loop portion 26 in the direction as indicated by arrow F2, the result is an overlapped double loop configuration having a small adjustable loop structure (at least partially defined by overlapping sections of loop portions) with a long pulling strap provided by another loop portion.

These various configurations of FIGS. 2A through 2F exemplify the ease with which the configuration, length and size of the exercise loop portion(s) can be changed according to the desire and need of the user. Knot 25 acts both as an adjustable cinch and a locking device to control the length of the loop portions as well as the tightness of the loop on the limb(s). During use of strap device 20, such as during a stretching exercise, by reducing the tension on the knot, with one hand the user can adjust the position of knot 25 and adjust the size of the loop portion(s). Applying tension again tightens the knot 25 and secures the new configuration.

Figure 3A:
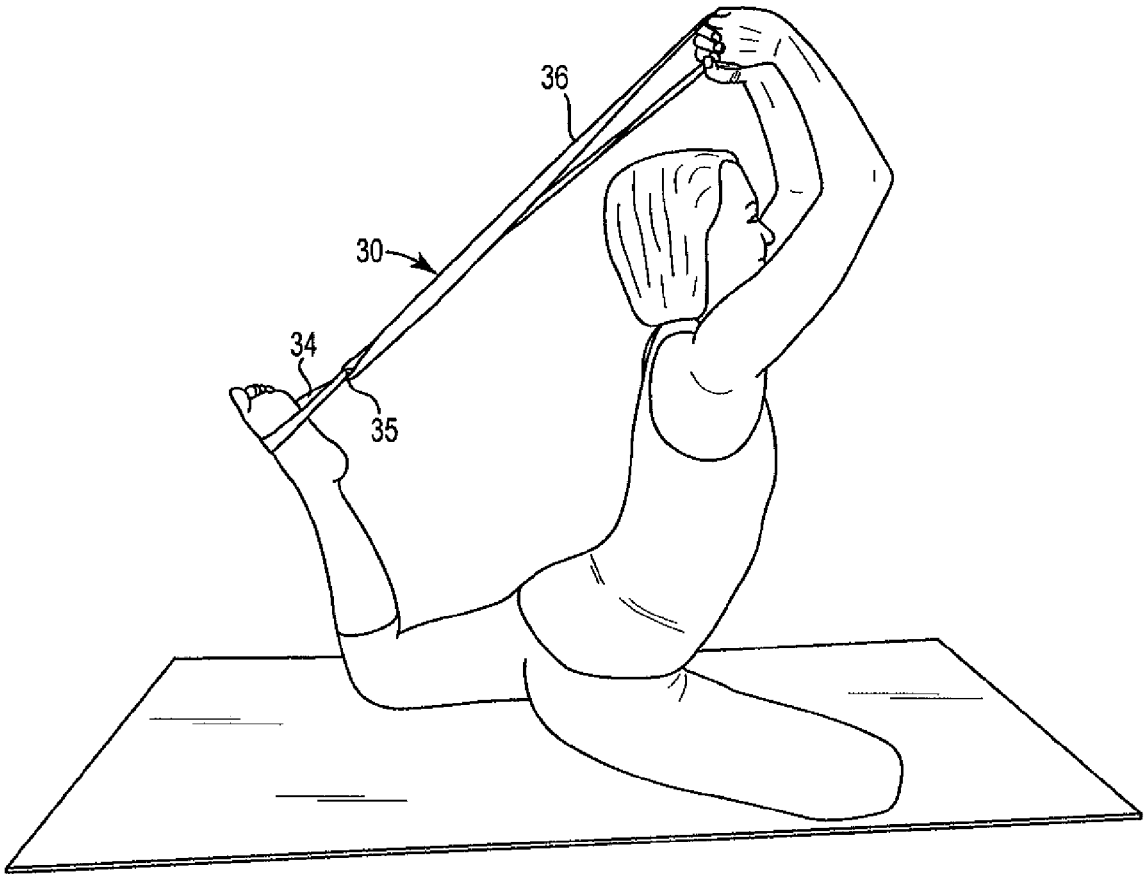
FIGS. 3A through 3C are isometric views of a user using a device of FIG. 1 for various stretching exercises.
Figure 3B:
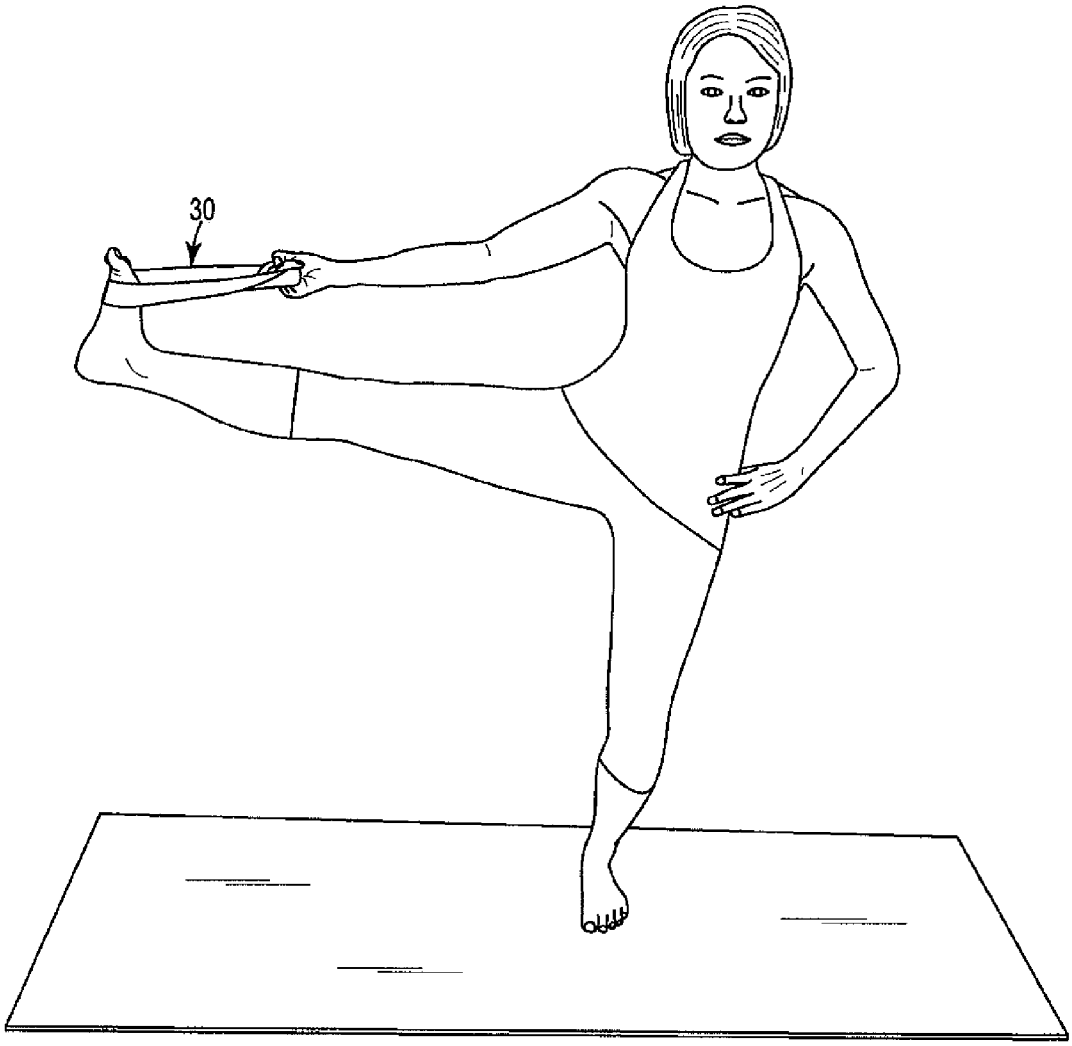
Figure 3C:
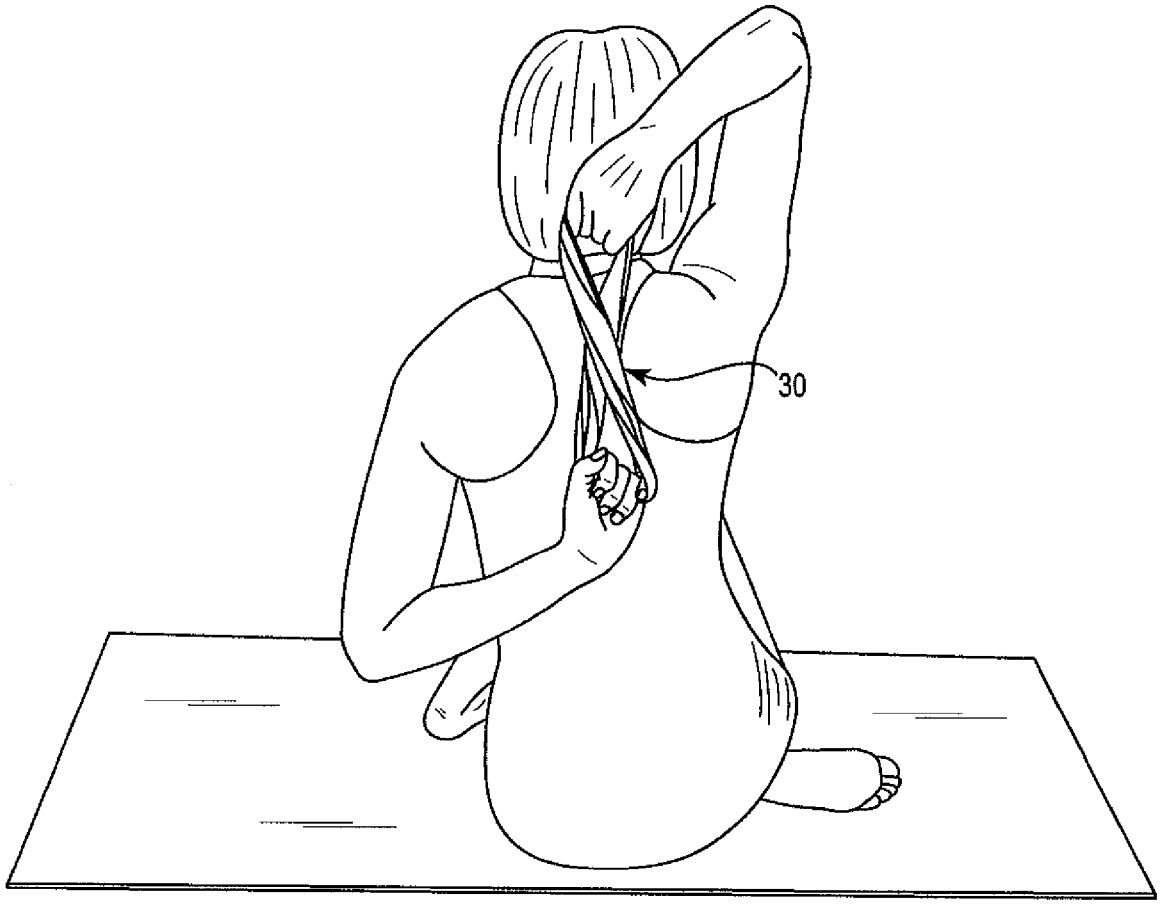

The closed loop devices of this disclosure can be used in a variety of exercises, and are particularly suited for use as an aid in stretching exercises. FIGS. 3A through 3C illustrate various stretching exercises done with a one knot closed loop device 30.

In FIG. 3A, a user is using loop device 30 configured in a manner similar to that of the device of FIG. 2A, with a knot 35 forming loop portions 34, 36 of unequal sizes. The user has a foot within smaller loop portion 34 and is using loop portion 36 as a pulling strap. In FIG. 3B, the user has doubled loop device 30 to form a configuration similar to that of the device of FIG. 2D having one loop. She uses the loop both as a foothold and a pulling strap. In FIG. 3C, the user is using loop device 30 again configured in a manner similar to that of the device of FIG. 2D, but with both hands pulling on device 30.

Figure 4A:
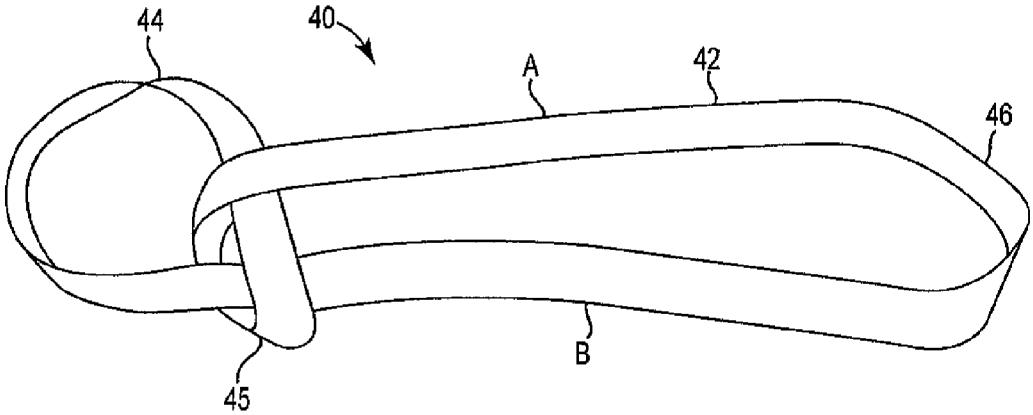
FIGS. 4A and 4B are plan views of the device of FIG. 1 used to secure an item for carrying.
Figure 4B:
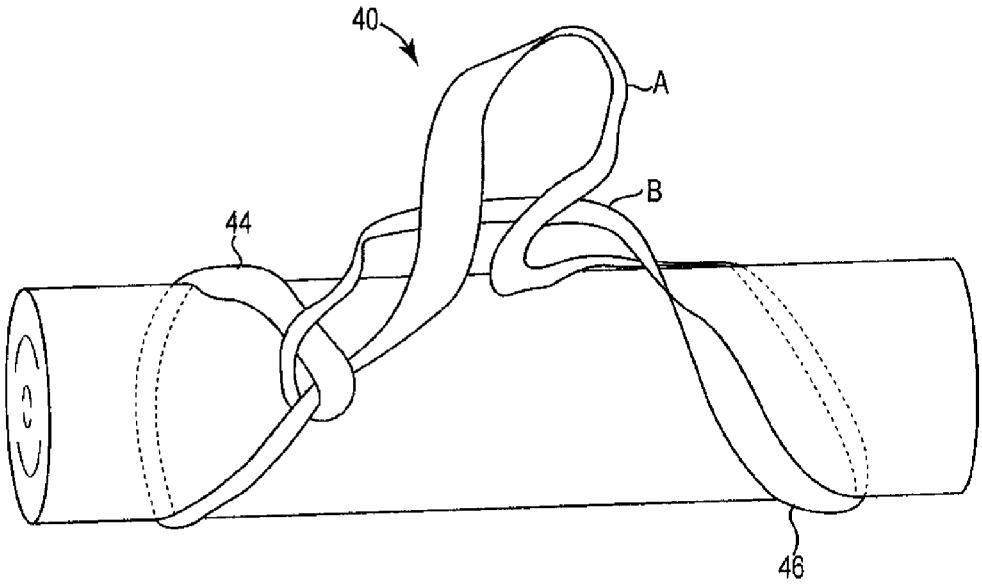

In addition to using the closed loop strap having a single knot as an exercise aid, the device can be used as a strap for securing and/or carrying items, such as a yoga mat or other exercise or sports equipment such as skis and/or poles, snowboards, or the like. In FIGS. 4A and 4B, a closed loop device 40 has a strap body 42 with a single knot 45 formed therein, providing a plurality of loop portions including loop portion 44 and loop portion 46. In FIG. 4B, device 40 is used to secure an elongate device, such as a rolled yoga mat. Device 40 may be used to secure and/or carry other exercise items, such as skis and/or their poles, golf clubs, and the like. Device 40 may additionally be used for non-exercise items, such as for carrying lumber (e.g., 2×4s), pipe, etc. Device 40 may additionally be used to secure items such as holding a door open or staking a tree. Device 40 may also be used for towing or hoisting items, or as a lifting aid.

Figure 9A:
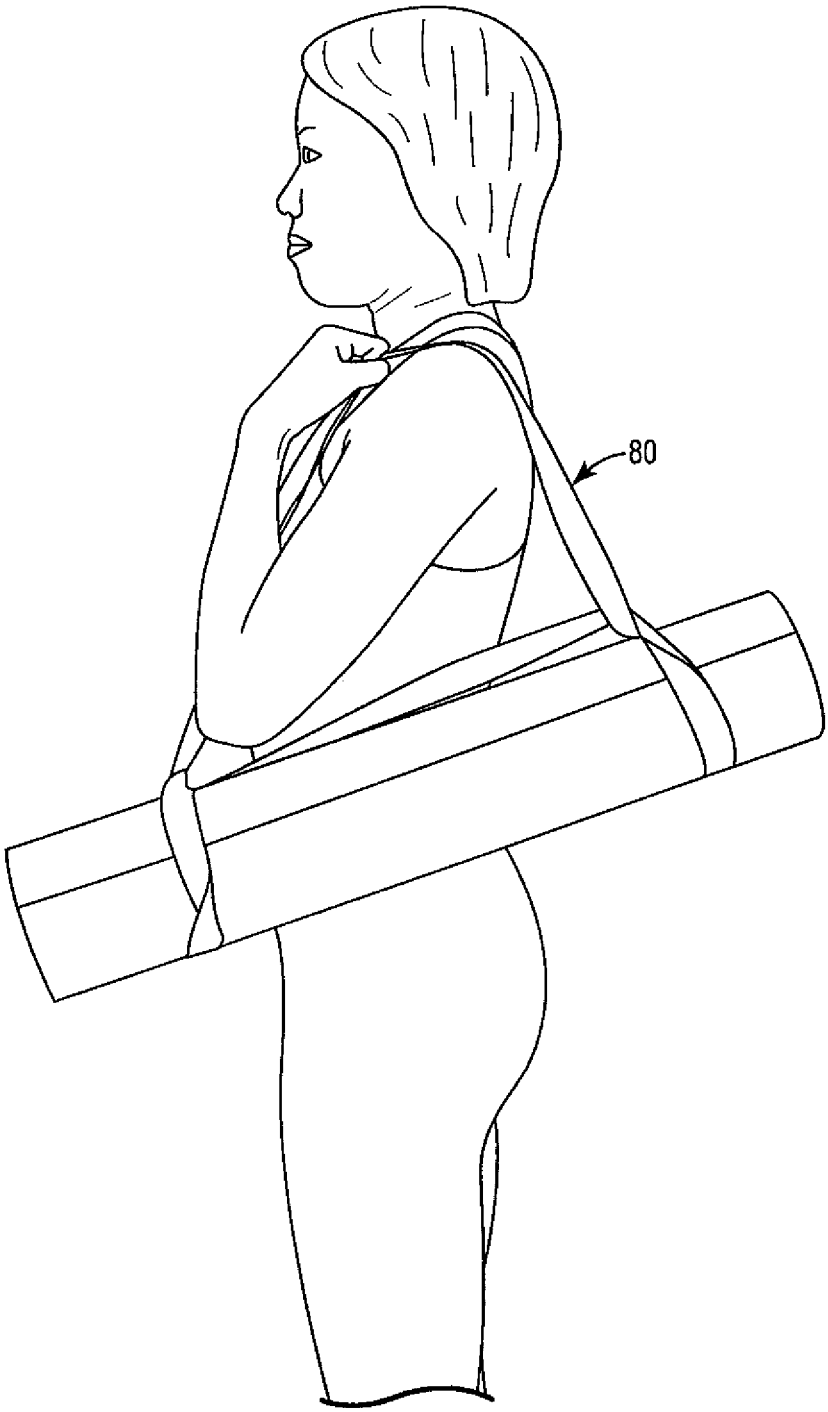
FIGS. 9A and 9B are isometric views of a user using a device of FIG. 4A to carry an item.
Figure 9B:
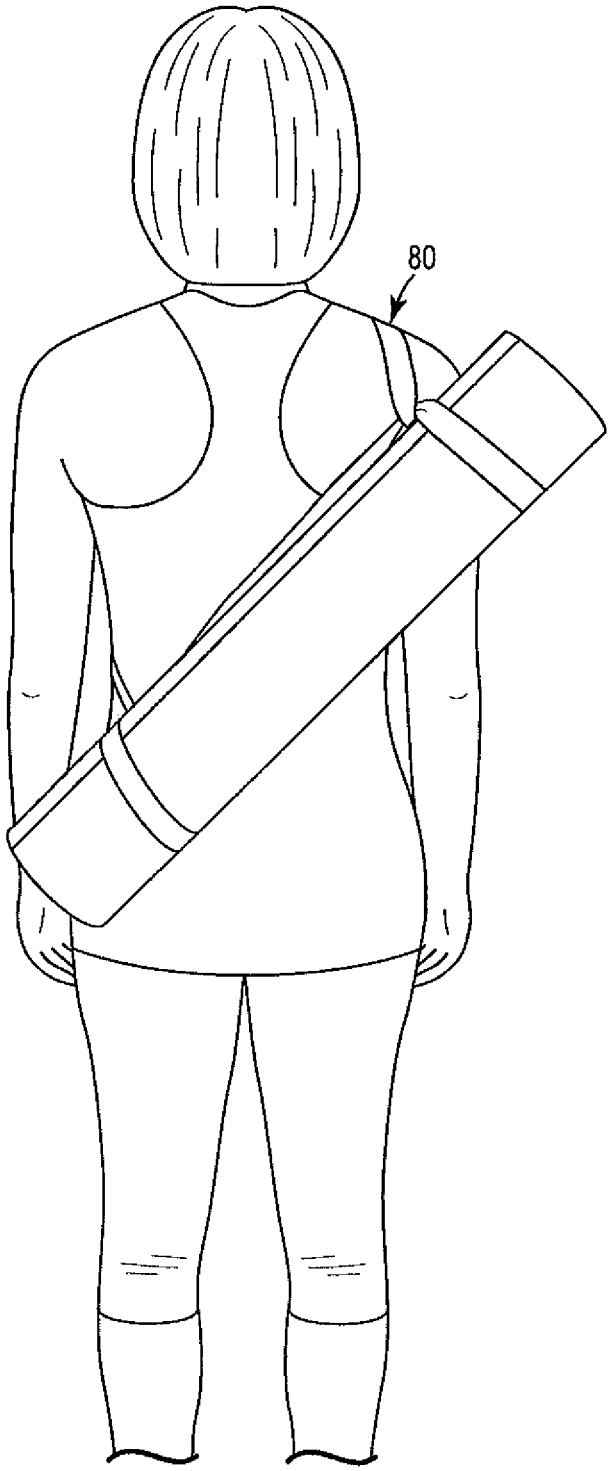

Returning to FIGS. 4A and 4B, to secure an item such as the rolled yoga mat, the item is placed through the smaller portion loop (in this embodiment, loop portion 44) so that the loop portion encircles the mat relatively close to one end. The larger loop portion (in this embodiment loop portion 46) is looped over the other end of the mat. A twist is formed in the middle of the larger loop portion to form a strap B and a handle A simultaneously to secure and to carry the mat. To form the twist, portion A of loop portion 46 is fed under portion B of loop portion 46. After device 40 is positioned on mat as desired, knot 45 can be secured as tightly as desired. This configuration has the attribute of firmly securing the mat while allowing rapid disengagement if desired. The mat can conveniently be carried in a manner similar to a briefcase or on the shoulder or the back like a sling, by using portion A as the handle as shown in FIGS. 9A and 9B.

Figure 5A:
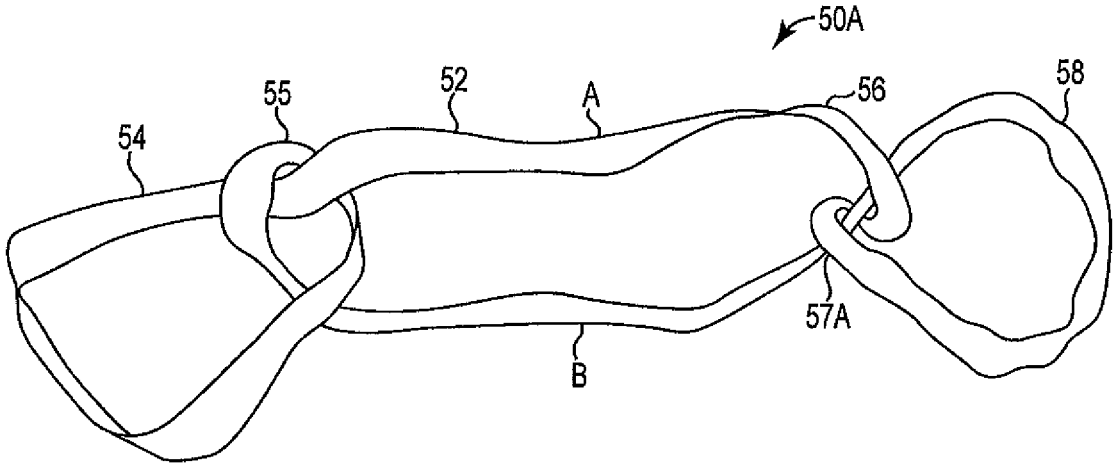
FIGS. 5A and 5B are plan views of closed loop devices having two indecomposable knots.
Figure 5B:
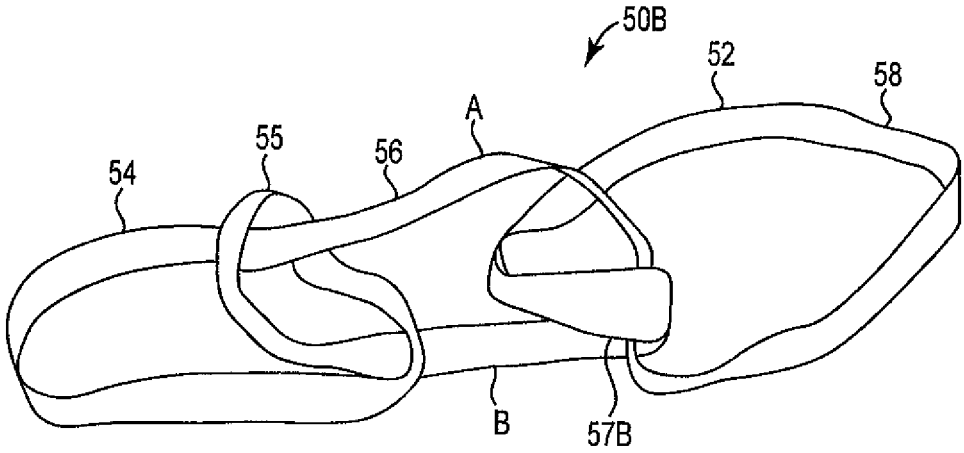

FIGS. 5A and 5B illustrate two configurations for additional embodiment of a flexible devices 50A and 50B according to this disclosure, each having two indecomposable knots. Closed loop device 50A of FIG. 5A has a strap body 52, with body 52 being continuous without a free end. Body 52 has a first knot 55 and a second knot 57A tied therein. Closed loop device 50B of FIG. 5B differs from device 50A of FIG. 5A only in that second knot 57B is a mirror image of knot 57A of FIG. 5A. Knots 55, 57A, 57B define a plurality of adjustable loop portions.

FIGS. 6A through 6F illustrate various configurations for closed loop device 50A. When no tension is on device 50A, one or both knots 55 and 57A, can be readily expanded and adjusted (e.g., pulled or moved) to change the sizes of any or all of the corresponding loop portions. Decreasing the size of one loop portion will increase the size of at least one other loop portion when using trefoil knots 55 and 57A. In this sense, the loop portions are dependently adjustable.

Figure 6A:
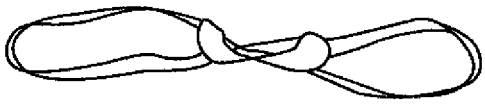
FIG. 6A is a plan view of the device of FIG. 5A or 5B with the knots tightened to form three adjustable loops.
Figure 6B:
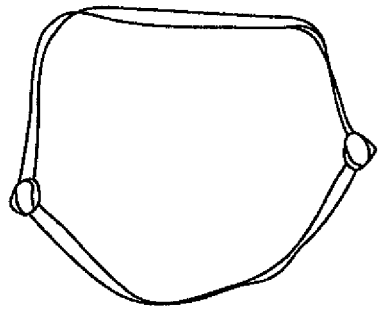
FIG. 6B is a plan view of the device with the knots completely tightened to form one single loop.
Figure 6C:
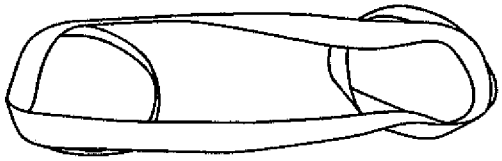
FIG. 6C is a plan view of the device forming symmetrical double-double loops, which are two smaller loops within a larger loop.
Figure 6D:
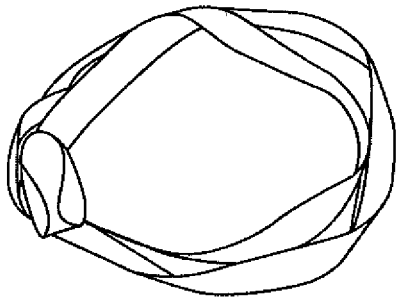
FIG. 6D is a plan view of the device doubled to form two overlapped loops.
Figure 6E:
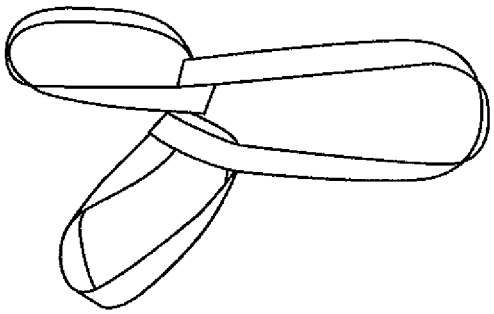
FIG. 6E is a plan view of the device forming a triangular form with three essentially equal loops.
Figure 6F:
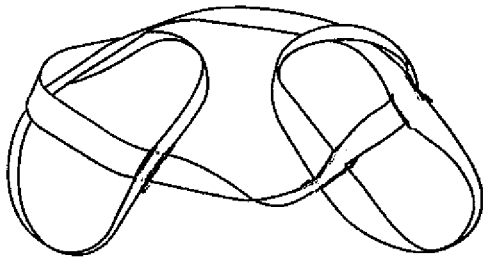
FIG. 6F is a plan view of the device with the knots loosened to form five adjustable loops.

In FIG. 6A, the device is adjusted to form a linear array of three loop portions. To form the one single loop configuration of FIG. 6B, the two knots are pulled apart from each other as much as possible and cinched tight, resulting in tight knots opposite each other on a single loop. FIG. 6C illustrates a symmetrical double-double loop configuration having three loops arranged linearly. In exercise use, the larger loop may provide a long pulling strap and the end loops may provide holds (e.g., footholds). FIG. 6D illustrates an overlapped double-double loop. Overlapped portions of the strap body form the configuration. This configuration may be readily made by doubling over the single loop configuration of FIG. 6A. The resulting device can be used both as a hold (e.g., handhold, foothold, etc.) and also as a pulling strap. FIG. 6E illustrates a triangular configuration of three triangularly oriented loops of independently adjustable size. Further, folding or otherwise overlapping all three loops of FIG. 6E on themselves results in a triple strength single loop somewhat smaller than the double loop of FIG. 6D. A quadruple loop configuration is illustrated in FIG. 6F.

FIGS. 6A through 6F exemplify the ease with which the length and size of the resultant loop(s) can be formed, sized, and secured according to the desire and need of the user. Each of the loops can perform various functions. Any of the loops may act as a strap or hold (e.g., handhold, foothold, etc.) for the limbs to enhance the stretching exercise as any person trained or skilled in the art of exercising would understand. Additionally, any of the loops may act as a pulling strap for applying tension to the hold. In some embodiments, a loop may be both a hold and a pulling strap (e.g., as illustrated in FIG. 3B and FIG. 3C). The knots act both as an adjustable cinch and a locking device to control the length of the loops as well as the tightness of the loops.

Figure 7A:
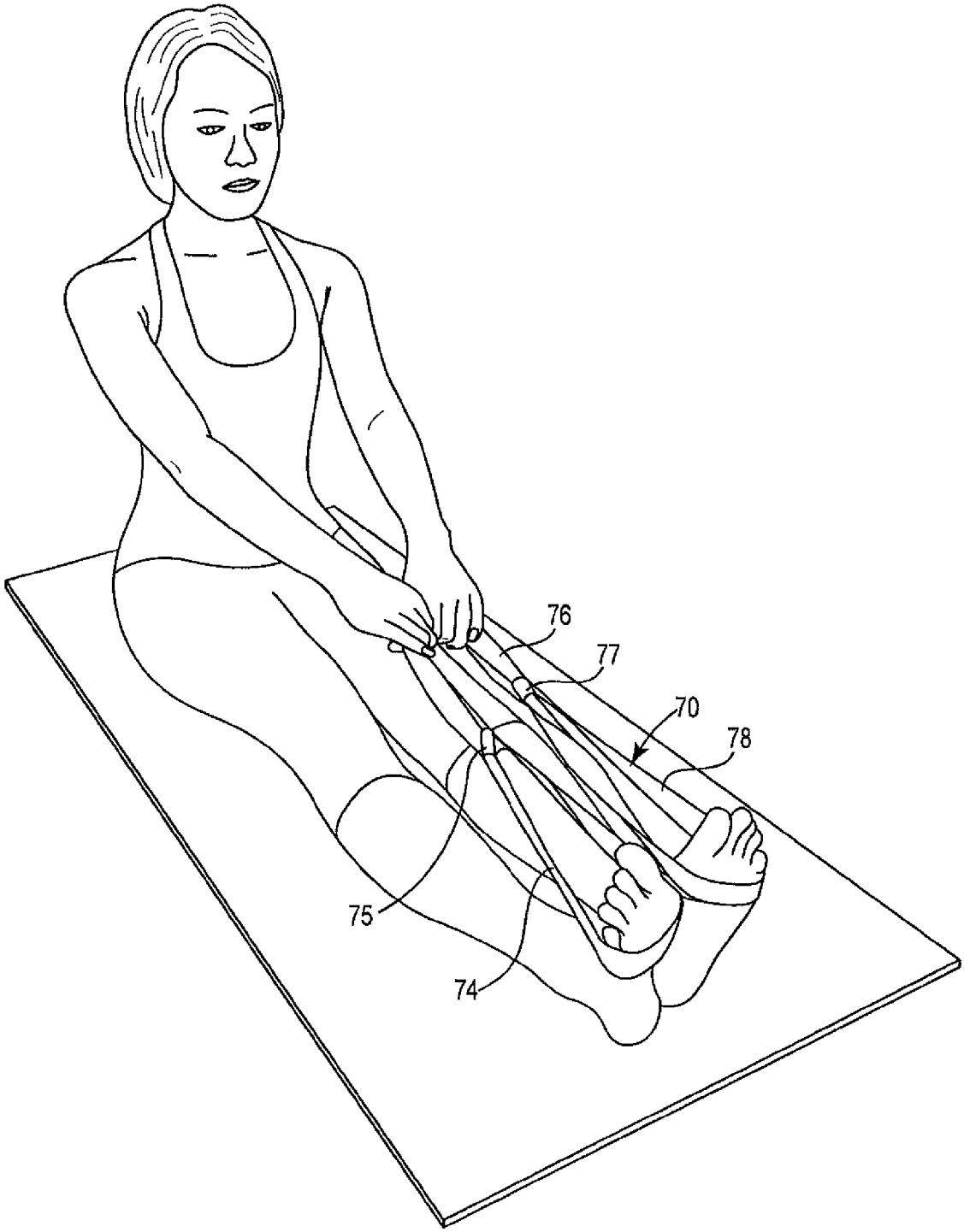
FIGS. 7A through 7C are isometric views of a user using a device of FIG. 5A or 5B for various stretching exercises.
Figure 7B:
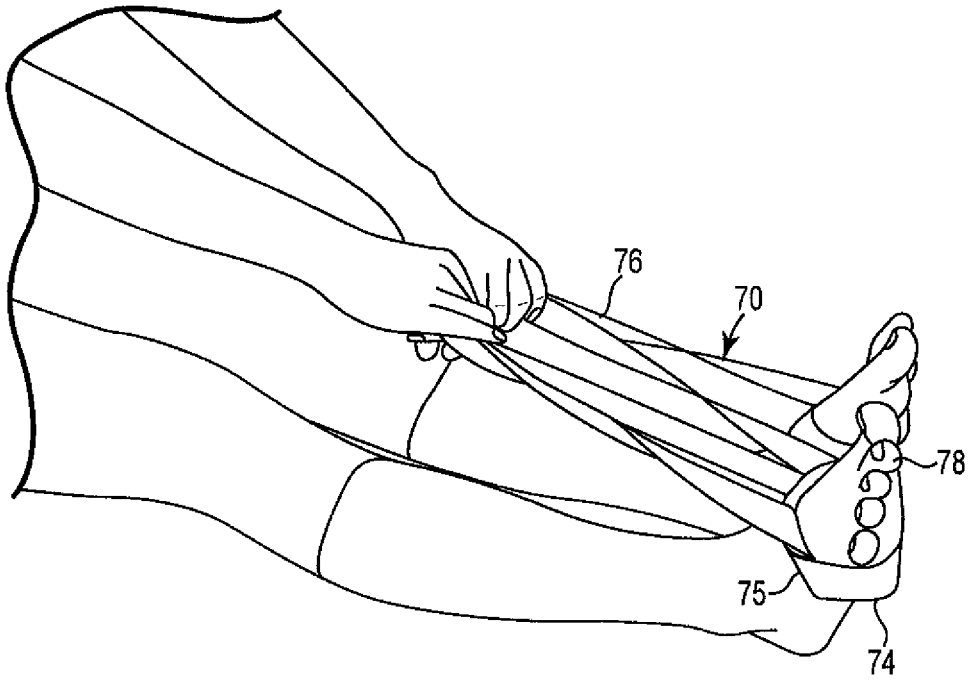
Figure 7C:
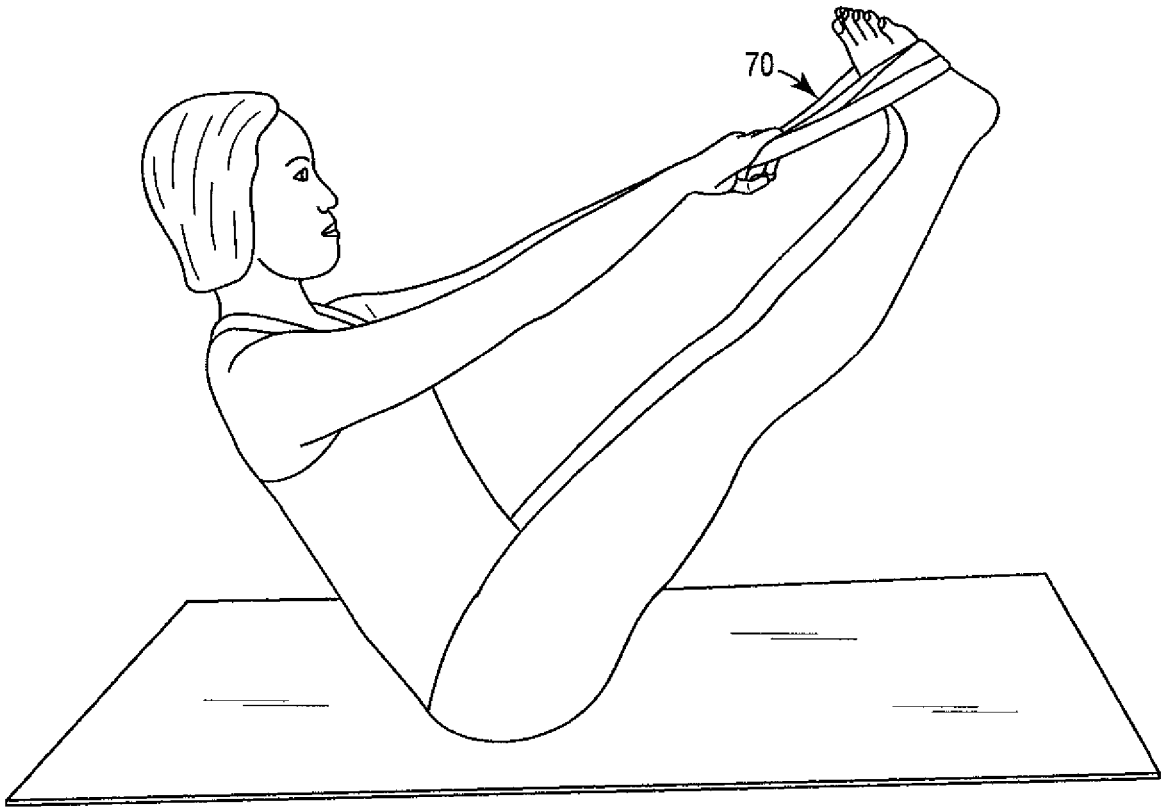

The closed loop devices of this disclosure, whether having one, two or more indecomposable knots, can be used for a variety of uses, and are particularly suited for stretching exercises. FIGS. 7A through 7C illustrate various stretching exercises done with a two knot closed loop device 70.

Figure 8A:
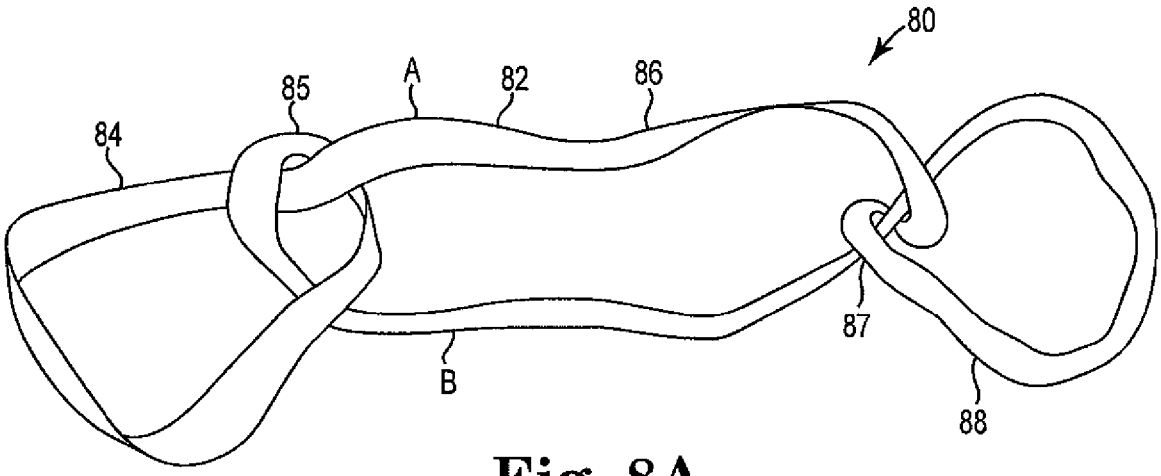
FIGS. 8A and 8B are plan views of the device of FIG. 5A used to secure an item for carrying.
Figure 8B:
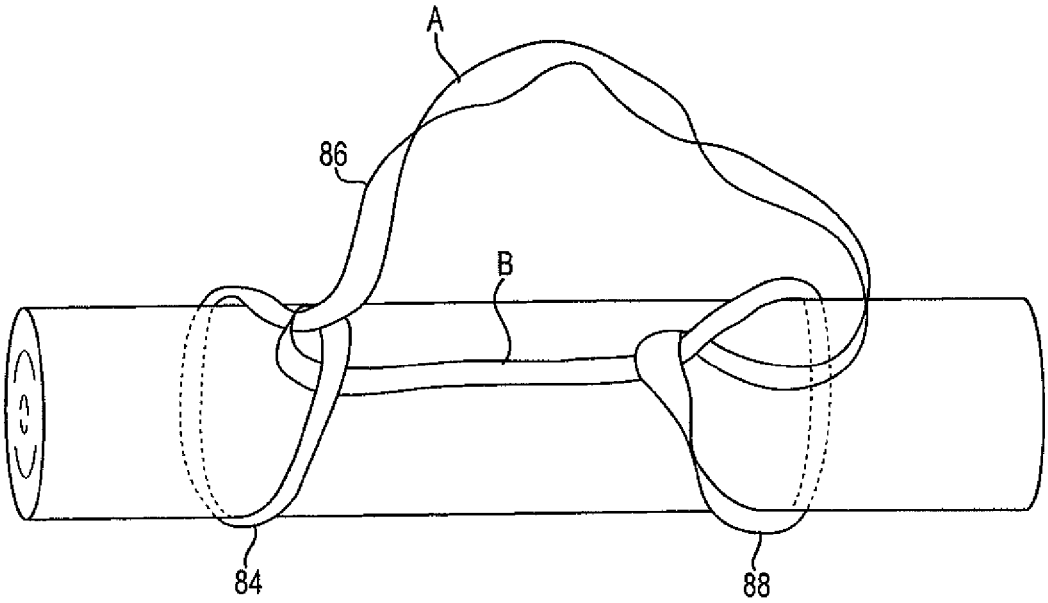

In FIG. 7A, a user is using device 70 configured in a manner similar to that of the device of FIG. 6A. The user has her feet within loop portions 74, 78 and is using loop portion 76 as a pulling strap. In FIG. 7B, the user has shorted loop portions 74, 78 of the strap device to form a configuration similar to that of the device of FIG. 6C. The double loop portions 74, 78 secure the user's feet, with knots 75, 77 in close proximity to the feet, and loop portion 76 is used as a pulling strap. It is seen that in this configuration, the pulling strap is shorter than the pulling strap in FIG. 7A. For an even shorter device, in FIG. 7C, loop device 70 is configured as a single loop, in a manner similar to that of the device of FIG. 6D. In FIGS. 8A and 8B, a closed loop device 80 has a strap body 82 with a first knot 85 and a second knot 87 formed therein, forming loop portions including loop portion 84, loop portion 86 and loop portion 88. In FIG. 8B, device 80 is used to secure an elongate item, such as a rolled yoga mat. To secure the item, the rolled mat is placed through loop portion 84 so that the loop encircles the mat relatively close to one end. The other end of the mat is then placed through loop portion 88. A handle is formed by loop portion 86. In FIG. 8B, portion A of loop portion 86 is a carrying handle and portion B of loop 86 extends between knots for stability. In other embodiments, portion B may be the handle, or, both portions A and B together may be used as a handle. The mat can conveniently be carried in a manner similar to a briefcase or like a sling on the shoulder or the back, by using portion A and/or portion B as the handle or sling.

Figure 10:
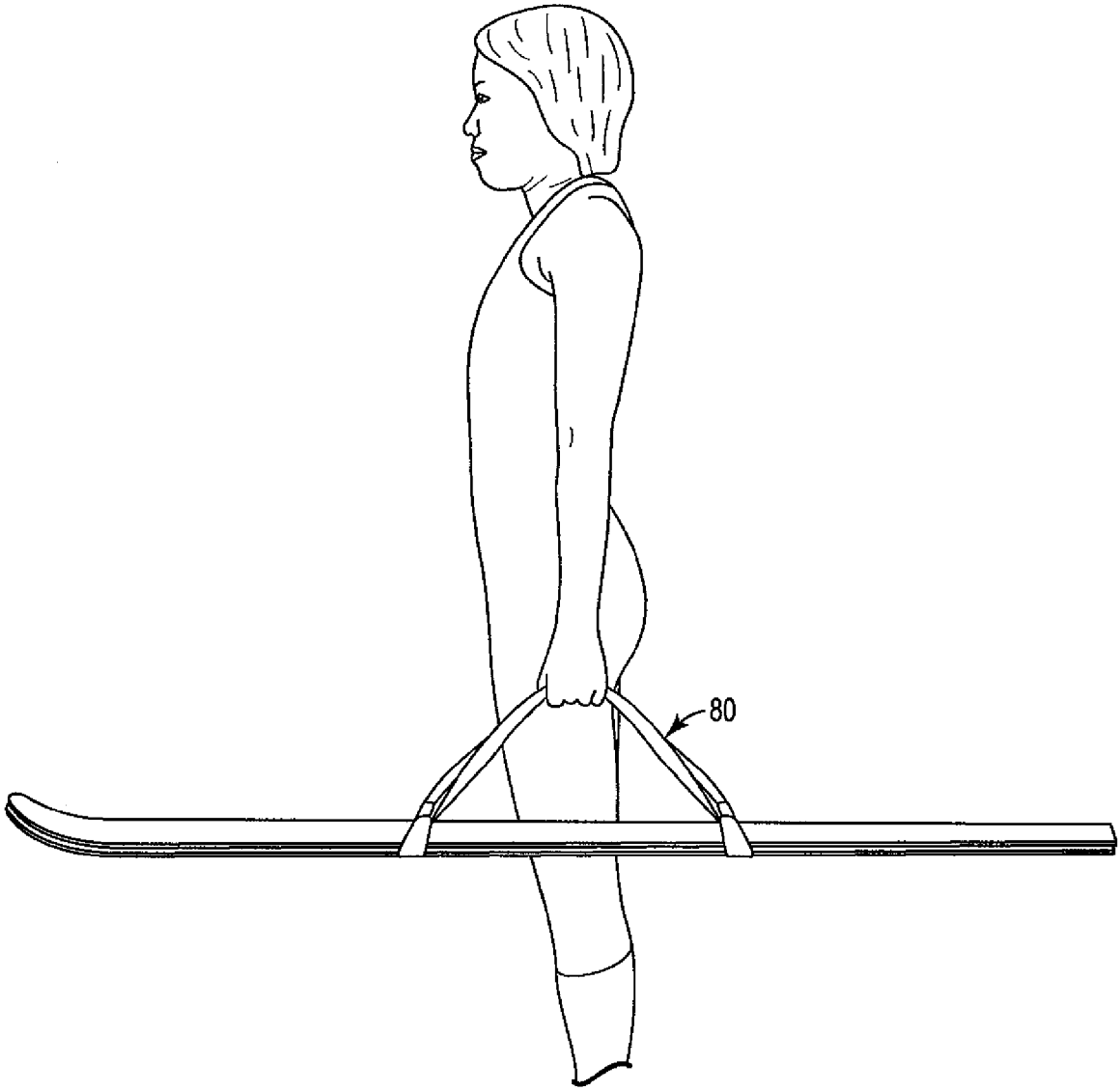
FIG. 10 is an isometric view of a user using a device of FIG. 5A to carry an item.

FIG. 10 illustrates a pair of skis secured together and carried via closed loop device 80. In this illustration, the skis are being carried in a manner similar to a suitcase, but could be alternately carried on the shoulder. When the user (skier) is ready to ski, she can easily remove strap device 80 from the skis and place it in a coat pocket or fanny pack. Because of its flexible nature, device 80 can be easily rolled, folded, or merely bunched up when not in use.

With the closed loop, two trefoil knot variation described above in regards to FIG. 5A and subsequent, the closed loop can be configured as desired with one or more loop portions, the sizes of which can be adjusted at will with the two indecomposable knots functioning as adjustable cinches and locking devices. Similar to the closed loop device with one knot, the two knot variation can be used to secure and/or carry items within its loops, to secure items, such as holding a door open or staking a tree, or for towing or hoisting items, or as a lifting aid.

In the various embodiments, the closed loop body of the devices of the present invention can be formed from a wide range of materials with a wide range of cross-sections. The bodies may be elastic or inelastic, but preferably are generally inelastic. The body material preferably is a flexible, inelastic webbing material in the form of a strap with opposed major faces. Strap material is commercially available in many suitable forms including as a durable woven or nonwoven material. Exemplary materials used to form the strap material include cotton, cotton blends or other canvas material, nylon, polypropylene, polyester, and/or the like. A soft, flexible and conformable material, which is soft and gentle on the limbs (e.g., toes, feet, fingers) is generally preferred by users over more abrasive materials.

The strap body often is at least ½ inch wide, but usually is at least 1 to 1½ inches wide. In most embodiments, the width of the strap body is no more than 6 inches. Cotton and cotton blend webbing that is 1 to 3 inches wide are examples of a suitable strap body, as they are sufficiently flexible to conform to a user's limb (e.g., foot, palm) yet sufficiently strong to withstand the force exerted thereon by pulling or carrying an item.

The length of the closed loop body is usually about 4 to 10 feet long before knots are formed, although longer and shorter lengths may be suitable, depending on the intended use of the strap device, the number of knots, and the intended user. For example, taller users may desire longer strap devices. Although the preferred configuration for the closed loop devices of this invention is with a strap body made from one or more durable woven or non-woven fabrics and/or polymer films, or the like, other materials and configurations for the body may be used. For example, when the closed loop device is specifically designated for towing or other high strength applications, the loop body may be a chain, cable, high tensile wire, and/or the like.

As described above, the at least one knot (e.g., knot 15, 25, 45, 55, 57A, 57B, etc.) is an indecomposable knot that in some embodiments is conveniently formed in the strap body before the closed loop is formed. A preferred knot is a trefoil knot. For embodiments having two or multiple trefoil knots, adjacent knots optionally may be mirror images (referred to as enantiomorphs in knot theory).

After the knot is formed, the two ends of the strap body may be permanently connected (e.g., by sewing, stitching, stapling, riveting, gluing, welding, or other permanent attachment system). In some embodiments, the strap device is not permanently closed, but may be reversibly opened and closed as desired by the user. The loop may be closed, for example, by tying the two ends together, with a belt buckle-type fastener, with a male-female quick snap fastener, with a hook and loop fastening system such as VELCRO™, with a double slot buckle, with a button, with a clasp, with a pin, and the like. Although a reversible closed loop device may be used for stretching and other exercises, a permanently closed loop is preferred, eliminating the opportunity of the fastener inadvertently opening, and eliminating pinch points and pressure points, etc. A non-permanent closed loop device may be desired, in some instances, when the device is used for securing and carrying items, such as a ski tote. Note that when the loop is closed, an indecomposable knot can be loosened, moved, tightened, or otherwise adjusted without the knot becoming untied.

The strap device of this disclosure has numerous features that result in a strap device different and better than existing strap devices. In addition to being flexible and comfortable to use, it is simple, straightforward and efficient, and easily adjustable without the need of tools or finger dexterity. The strap device can be quickly and easily adjusted to form the desired configuration. Many users will be able to quickly discern the vast number of configurations available with the strap device and will be able to begin immediate use. In some embodiments, instructions indicative of using the device may be included with the device, for example, instructions for using the device as an exercise aid, as a carrying strap or tote, or as a towing strap.

In some embodiments, the strap device has no clasps, buckles or other hardware that could create a pressure point, pinch point or sharp edge. Because of the simple design and the avoidance of hardware, the strap device is easy to carry and store, being readily collapsible with minimal tangling. Additionally, because of the simple design and the avoidance of hardware, the strap device is very cost reasonable. The speed which the device can be adjusted is an important attribute, making the device easy to use.

Thus, embodiments of CLOSED LOOP DEVICE INCORPORATING ONE OR MORE INDECOMPOSABLE KNOTS AND METHODS OF USING are disclosed. Various modifications and alterations of this invention will become apparent to those skilled in the art without departing from the scope and spirit of this invention, and it should be understood that this invention is not to be unduly limited to the illustrative embodiments set forth herein. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. An exercise device, comprising:

a flexible, closed loop body, and at least one indecomposable knot formed in the loop body by a portion of the closed loop body and that cannot be removed when the flexible body is closed, the knot defining a plurality of dependently adjustable loop portions, and with the indecomposable knot capable of being cinched to secure the loop portions.

2. The exercise device of claim 1 wherein the at least one indecomposable knot can be cinched under tension to secure the sizes of the adjustable loop portions and the knot can be uncinched to allow adjustment of the loop portion sizes.

3. The exercise device of claim 2 wherein at least one indecomposable knot is a prime knot.

4. The exercise device of claim 3 wherein the prime knot is a trefoil knot.

5. The exercise device of claim 1 wherein a portion of the closed loop body is freely movable through the indecomposable knot when the knot is uncinched in a manner effective to allow adjustment of at least one loop portion.

6. The exercise device of claim 1 comprising first and second indecomposable knots formed in the closed loop body.

7. The exercise device of claim 1 wherein the closed loop body is a strap having opposed major surfaces.

8. The exercise device of claim 7 wherein the loop body has a first end and a second end that are permanently joined to form the closed loop.

9. A method of exercise comprising:

providing a closed loop device comprising a flexible body forming a continuous loop with at least one indecomposable knot formed in the body by a portion of the loop body and that cannot be removed when the flexible body is a closed loop, the knot defining a plurality of dependently adjustable loop portions, with the knot capable of being cinched to secure the loop portions; and using the device as an exercise aid.

10. The method of claim 9 wherein the using step comprises using the device to assist with an exercise selected from stretching a yoga position.

11. The method of claim 9, wherein the using step comprises providing the body in a configuration comprising at least three dependently adjustable loop portions, adjusting a first loop portion in a manner effective to adjust the sizes of the other two loop portions, and cinching the knot to secure the sizes of the adjusted loop portions.

12. The method of claim 11, wherein the adjusting step and the cinching step occur during a stretching exercise.

13. A method of carrying at least one item, comprising:

providing a closed loop device comprising at least one indecomposable knot formed in a body by a portion of the body, the knot cannot be removed when the flexible body is a closed loop, the knot defining at least first and second dependently adjustable loop portions;

placing the at least one item in the first loop portion;

cinching the knot to secure the loop portions and the at least one item in the first loop portion; and using the second loop portion as a handle to carry the at least one item.

14. The method of claim 13 wherein the at least one item is selected from an exercise mat, a snow ski, ski pole, or a water bottle.

15. The method of claim 13 wherein the closed loop device comprises a first indecomposable knot and a second indecomposable knot formed in the body, the knots defining at least the first adjustable loop portion, the second adjustable loop portion, and a third adjustable loop portion, and the method further includes a step of placing the at least one item in the third loop portion.

16. The method of claim 13 wherein the body has a first end and a second end that are permanently joined to form the closed loop.

17. The method of claim 13 wherein the body has a first end and a second end that are temporarily joined to form a reversibly closed and opened closed loop.

18. A closed loop device with adjustable loop portions, comprising:

a flexible body forming a continuous loop, and at least two indecomposable knots formed in the loop body, each knot formed by a portion of the loop body and which cannot be removed from the loop while the body is a continuous loop, the knots defining a plurality of dependently adjustable loop portions.

19. The device of claim 18 wherein the body has a first end and a second end that are permanently joined to form the continuous loop.

20. The device of claim 18 wherein the body is a chain, a rope, a strap, a cable, or a wire.

21. Using the device of claim 18 as a tow strap.

22. Using the device of claim 18 as a connection between at least two items.

* * * * *